US008607751B2

(12) United States Patent
Yang et al.

(10) Patent No.: US 8,607,751 B2
(45) Date of Patent: Dec. 17, 2013

(54) ELECTRO-HYDRAULIC VARIABLE VALVE LIFT SYSTEM

(75) Inventors: Jei Choon Yang, Yongin-si (KR); Byong Young Choi, Bucheon-si (KR); Young Hong Kwak, Suwon-si (KR); Wonjun Lee, Hwaseong-si (KR); Jin Kook Kong, Suwon-si (KR); Soo Hyung Woo, Yongin-si (KR)

(73) Assignee: Hyundai Motor Company, Seoul (KR)

( * ) Notice: Subject to any disclaimer, the term of this patent is extended or adjusted under 35 U.S.C. 154(b) by 36 days.

(21) Appl. No.: 13/528,616

(22) Filed: Jun. 20, 2012

(65) Prior Publication Data

US 2013/0146002 A1 Jun. 13, 2013

(30) Foreign Application Priority Data

Dec. 7, 2011 (KR) ..... 10-2011-0130514

(51) Int. Cl.
*F01L 1/34* (2006.01)

(52) U.S. Cl.
USPC ..... 123/90.16; 123/90.11; 123/90.12

(58) Field of Classification Search
USPC ..... 123/90.12, 90.11, 90.16, 90.48, 90.59
See application file for complete search history.

(56) References Cited

U.S. PATENT DOCUMENTS 7,500,466 B2 * 3/2009 Noss et al. ..... 123/321

FOREIGN PATENT DOCUMENTS

JP 3946426 B2 4/2007
KR 1020110062626 A 6/2011

* cited by examiner

*Primary Examiner* — Zelalem Eshete
(74) *Attorney, Agent, or Firm* — Morgan, Lewis & Bockius LLP

(57) ABSTRACT

An electro-hydro valve lift system may include a drive cam, a pump piston, a first and a second EHV apparatus, a first oil control valve, a first oil control hydraulic line fluid-communicating the main chamber with the first oil control valve, a second oil control hydraulic line fluid-communicating the first oil control valve with the first EHV apparatus, a third oil control hydraulic line fluid-communicating the main chamber with the second EHV apparatus, a fourth oil control hydraulic line selectively fluid-communicated with the second oil control hydraulic line according to the first oil control valve, an accumulator fluid-communicated with the fourth oil control hydraulic line, and a second oil control valve disposed on the fourth oil control hydraulic line, wherein the fourth oil control hydraulic line is fluid-communicated with the third oil control hydraulic line according to the second oil control valve.

12 Claims, 6 Drawing Sheets

ELECTRO-HYDRAULIC VARIABLE VALVE LIFT SYSTEM

CROSS-REFERENCE TO RELATED APPLICATION

The present application claims priority to Korean Patent Application No. 10-2011-0130514 filed in the Korean Intellectual Property Office on Dec. 7, 2011, the entire contents of which is incorporated herein for all purposes by this reference.

BACKGROUND OF THE INVENTION

1. Field of the Invention

The present invention relates to an electro-hydraulic variable valve lift system. More particularly, the present invention relates to an electro-hydraulic variable valve lift system which may realize asymmetric valve lift according to engine operation condition.

2. Description of Related Art

An internal combustion engine generates power by burning fuel in a combustion chamber in air media drawn into the chamber. Intake valves are operated by a camshaft in order to intake the air, and the air is drawn into the combustion chamber while the intake valves are open.

In addition, exhaust valves are operated by the camshaft, and a combustion gas is exhausted from the combustion chamber while the exhaust valves are open.

An optimal operation of the intake valves and the exhaust valves depends on a rotation speed of the engine. That is, an optimal lift or optimal opening/closing timing of the valves depends on the rotation speed of the engine.

In order to achieve such an optimal valve operation depending on the rotation speed of the engine, various researches, such as designing of a plurality of cam and a variable valve lift (VVL) that can change valve lift according to engine speed, a variable valve timing apparatus (VVT) that can change opening/closing time of a valve, an EHV (electro-hydro valve lift) have been undertaken.

A generally-used EHV apparatus applied to an internal combustion engine has identical valve lifts of intake valves per cylinder.

Recently a GDI (gasoline direct injection) engine has been used worldwide, and the GDI engine may improve compress ratio by injecting fuel into a cylinder directly and may suppress knocking.

However, in the GDI engine, air inflowing into a cylinder is not sufficient and thus air-fuel mixing is difficult, and noxious exhaust gas may be generated excessively.

For solving the drawbacks, asymmetric valve lifts for each cylinder is effective.

However, for having intake valve lift differently per cylinder, two independent EHVs are required for each valve and thus scheme may be complicated and production cost may be increased.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing an electro-hydraulic variable valve lift system which may realize asymmetric valve lift according to engine operation condition.

In an aspect of the present invention, an electro-hydro valve lift (EHV) system may include a drive cam, a pump piston housing of which a main chamber is formed therein, a pump piston which is disposed within the pump piston housing and reciprocates according to operation of the drive cam, a pump piston elastic member which is disposed within the pump piston housing and supplies restoring force to the pump piston, a first and a second EHV apparatus disposed to each cylinder, a first oil control valve, a first oil control hydraulic line fluid-communicating the main chamber with the first oil control valve, a second oil control hydraulic line fluid-communicating the first oil control valve with the first EHV apparatus, a third oil control hydraulic line fluid-communicating the main chamber with the second EHV apparatus, a fourth oil control hydraulic line of which an end is selectively fluid-communicated with the second oil control hydraulic line according to operation of the first oil control valve and of which the other end is fluid-communicated with the third oil control hydraulic line, an accumulator fluid-communicated with the fourth oil control hydraulic line, and a second oil control valve which is disposed on the fourth oil control hydraulic line and selectively communicates the second EHV apparatus with the accumulator, wherein the fourth oil control hydraulic line is fluid-communicated with the third oil control hydraulic line according to operation of the second oil control valve.

The first oil control valve and the second oil control valve selectively fluid-communicates the second oil control hydraulic line and the third oil control hydraulic line with the fourth oil control hydraulic line simultaneously, or the first oil control valve and the second oil control valve selectively fluid-communicates the second oil control hydraulic line and the third oil control hydraulic line with the fourth oil control hydraulic line sequentially.

The first oil control valve may include an oil control valve housing connected with the fourth oil control hydraulic line, the second oil control hydraulic line and the first oil control hydraulic line, and a plunger which is slidably disposed within the oil control valve hosing and of which a plunger hydraulic line is formed thereto, wherein the plunger hydraulic line fluid-communicates the fourth oil control hydraulic line with the second oil control hydraulic line, or fluid-communicates the second oil control hydraulic line with the first oil control hydraulic line, in accordance with operation of the plunger.

The first oil control valve may further include a coil selectively moving the plunger, and a plunger spring mounted to an end portion of the plunger and supplying restoring force to the plunger.

The accumulator may include an accumulator housing fluid-connected with the fourth oil control hydraulic line, an accumulator piston which is disposed within the accumulator housing and slidable according to receiving oil supplied from the fourth oil control hydraulic line, and an accumulator spring which is disposed within the accumulator housing and supplies restoring force to the accumulator piston.

The system may further include an engine hydraulic pump disposed on the fourth oil control hydraulic line.

The system may further include a check valve disposed between the engine hydraulic pimp and the fourth oil control hydraulic line and selectively blocking oil supplied from the engine hydraulic pump to the fourth oil control hydraulic line according to an oil pressure applied thereto, and a check valve spring elastically supporting the check valve toward the engine hydraulic pump.

The first and second EHV apparatus may include respectively an EHV housing, a hydraulic piston which is slidable within the EHV housing according to a hydraulic pressure within the main chamber and may include a first body having a first diameter, and a second body connected to the first body and a valve and having a second diameter larger than the first diameter, and a piston guide disposed between the EHV housing and the hydraulic piston and guiding the hydraulic piston.

The piston guide is disposed between the first body and the EHV housing, the first body and the piston guide form a first assist chamber, and the second body, the EHV housing, and the piston guide form a second assist chamber, wherein the first body is provided with a first hydraulic piston hydraulic line selectively connecting the first assist chamber and the second assist chamber according to operation of the hydraulic piston, and a second hydraulic piston hydraulic line continuously connecting the first assist chamber and the second assist chamber.

The first hydraulic piston hydraulic line is closed by the piston guide when the valve is closed and the second body of the hydraulic piston contacts the piston guide.

The second body is provided with a hydraulic pressure valve lash adjuster for adjusting clearance of the valve.

The hydraulic pressure valve lash adjuster may include a first lash adjusting chamber formed to the second body, a first lash adjusting hydraulic line formed to the EHV housing, a second lash adjusting hydraulic line formed to the second body for selectively connecting the first lash adjusting chamber and the first lash adjusting hydraulic line, a lash adjusting housing slidably receiving the second body to form a second lash adjusting chamber with the second body and connected with the valve, a lash adjusting spring disposed between the lash adjusting housing and the second body in the second lash adjusting chamber and elastically supporting the lash adjusting housing and the second body, a communication hole formed in the second body and fluid-communicating the first lash adjusting chamber with the second lash adjusting chamber, a one-way valve disposed within the lash adjusting housing and selectively closing the fluid-communicate hole, and a one-way valve spring elastically supporting the one-way valve.

An electro-hydraulic variable valve lift system according to an exemplary embodiment of the present invention may realize asymmetric valve lift in each cylinder according to engine operation condition with simple scheme.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
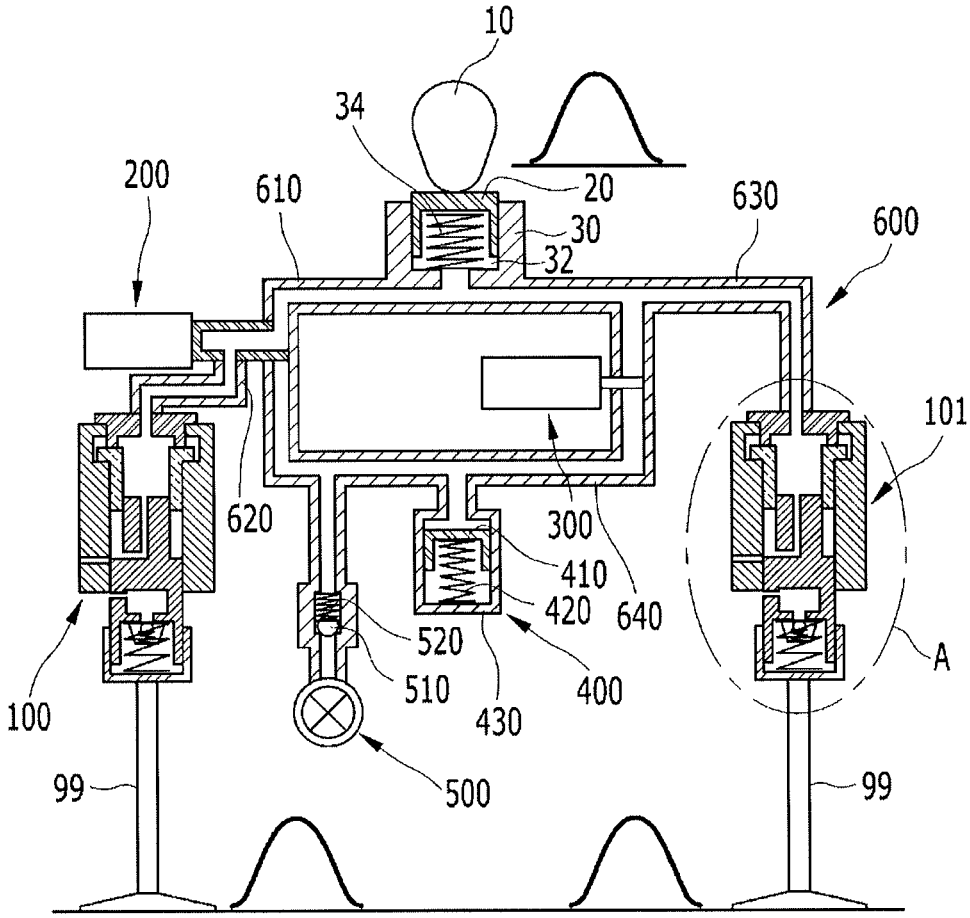
FIG. 1 and FIG. 4 are schematic diagrams of an electro-hydraulic variable valve lift system (EHV system) according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

As those skilled in the art would realize, the described embodiments may be modified in various different ways, all without departing from the spirit or scope of the present invention. Like numerals refer to like elements throughout the specification.

In the drawings, the thickness of layers, films, panels, regions, etc., are exaggerated for clarity.

Figure 4:
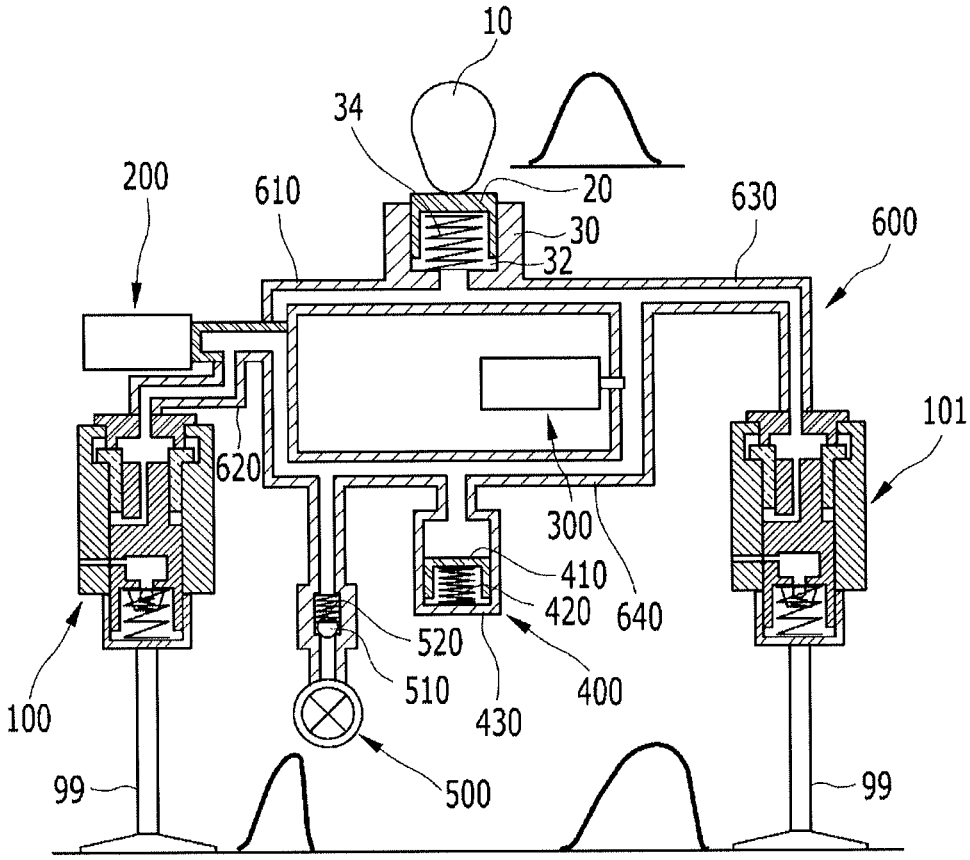

FIG. 1 and FIG. 4 are schematic diagrams of an electro-hydraulic variable valve lift system (EHV system) according to an exemplary embodiment of the present invention.

Figure 2:
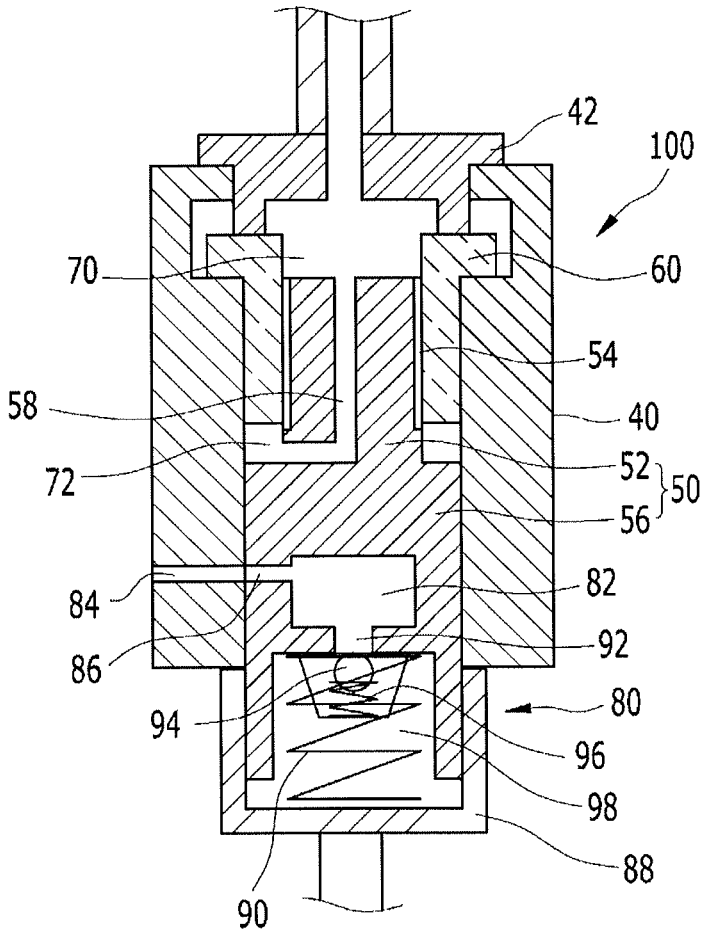
FIG. 2 is a cross-sectional view of an EHV apparatus applied to an EHV system according to an exemplary embodiment of the present invention.

Referring to FIG. 1, FIG. 2 and FIG. 4, an EHV (electro-hydro variable valve) system according to an exemplary embodiment of the present invention includes a drive cam 10, a pump piston housing 30 of which a main chamber 32 is formed therein, a pump piston 20 which is disposed within the pump piston housing 30 and reciprocates according to operation of the drive cam 10, a pump piston elastic portion 34 which is disposed within the pump piston housing 30 and supplies restoring force to the pump piston 20, a first and a second EHV (electro-hydro variable valve) apparatus 100 and 101 disposed to each cylinder, a first oil control valve 200, a second oil control valve 300, an accumulator 400, and an oil control hydraulic line 600 connecting each constituent element.

The oil control hydraulic line 600 includes a first oil control hydraulic line 610 communicating the main chamber 32 with the first oil control valve 200, a second oil control hydraulic line 620 communicating the first oil control valve 200 with the first EHV apparatus 100, a third oil control hydraulic line 630 communicating the main chamber 32 with the second EHV apparatus 101, and a fourth oil control hydraulic line 640 of which an end is selectively communicated with the second oil control hydraulic line 620 according to operation of the first oil control valve 200 and of which the other end is communicated with the third oil control hydraulic line 630.

The accumulator 400 is communicated with the fourth oil control hydraulic line 640, and the second oil control valve 300 is disposed on the fourth oil control hydraulic line 640 and selectively communicates the second EHV apparatus 101 with the accumulator 400.

The first oil control valve and the second oil control valve selectively communicate the second oil control hydraulic line and the third oil control hydraulic line with the fourth oil control hydraulic line simultaneously.

The first oil control valve 200 and the second oil control valve 300 selectively communicates the second oil control hydraulic line 620 and the third oil control hydraulic line 630 with the fourth oil control hydraulic line 640 sequentially, or the first oil control valve 200 and the second oil control valve 300 selectively communicates the second oil control hydraulic line 620 and the third oil control hydraulic line 630 with the fourth oil control hydraulic line 640 sequentially.

That is, the first oil control valve 200 is connected with the first oil control hydraulic line 610, the fourth oil control hydraulic line 640 and the second oil control hydraulic line 620 and selectively communicates the first oil control hydraulic line 610 with the second oil control hydraulic line 620, or selectively communicates the fourth oil control hydraulic line 640 with the second oil control hydraulic line 620.

The second oil control valve 300 selectively communicates the third oil control hydraulic line 630 with the fourth oil control hydraulic line 640.

The scheme of the first oil control valve 200, the first oil control hydraulic line 610, the second oil control hydraulic line 620 and the fourth oil control hydraulic line 640 are briefly shown in FIG. 1 and FIG. 4 for convenience. The detailed scheme will be described referring to FIG. 3 and FIG. 5.

Figure 3:
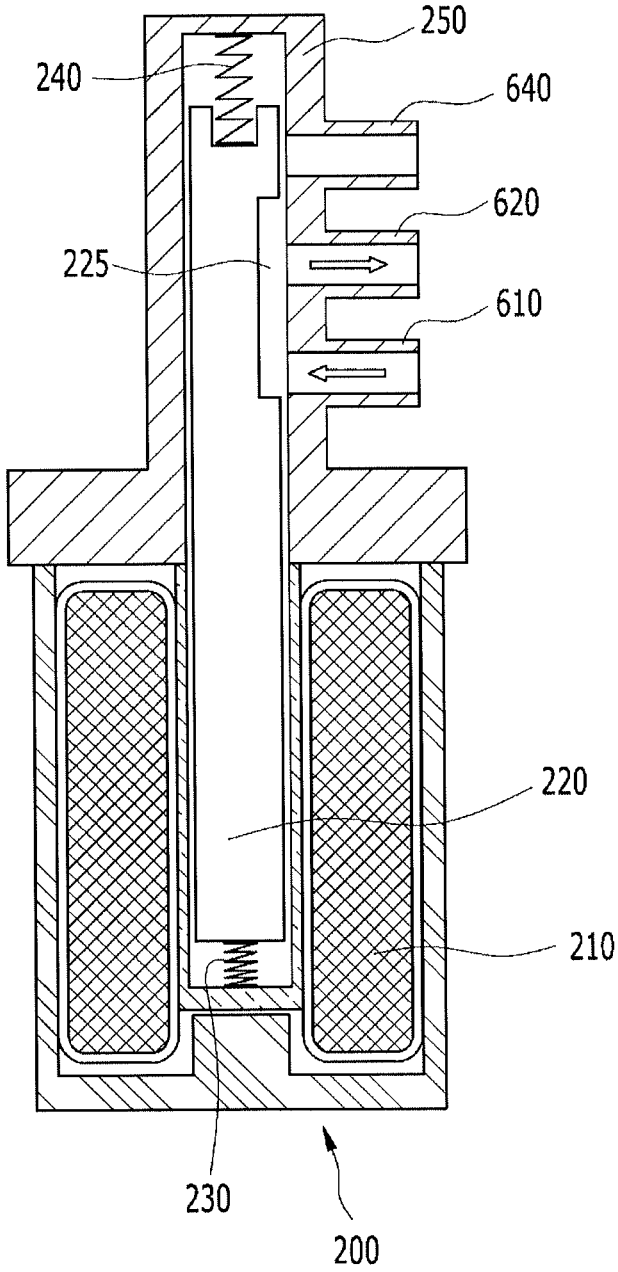
FIG. 3 and FIG. 5 are drawings showing a first oil control valve of an EHV system according to an exemplary embodiment of the present invention.
Figure 5:
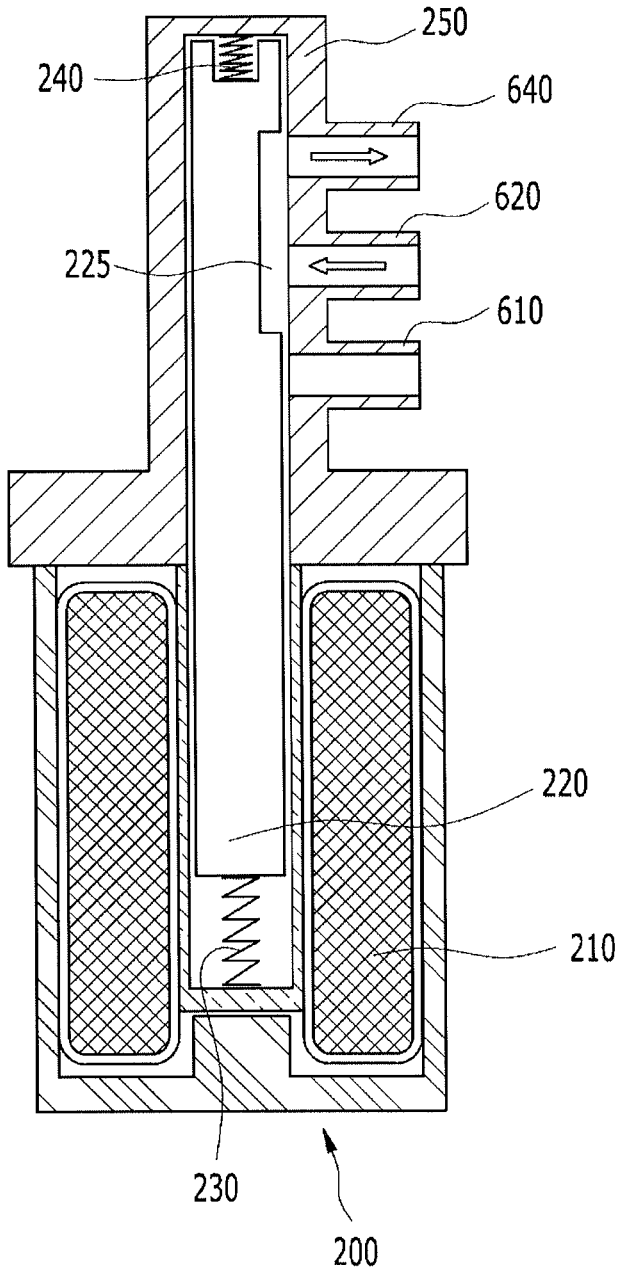

FIG. 3 and FIG. 5 are drawings showing a first oil control valve of an EHV system according to an exemplary embodiment of the present invention.

FIG. 3 and referring to FIG. 5, the first oil control valve 200 which is applied to the EHV system according to an exemplary embodiment of the present invention includes an oil control valve housing 250 connected with the fourth oil control hydraulic line 640, the second oil control hydraulic line 620 and the first oil control hydraulic line 610, and a plunger 220 which is slidably disposed within the oil control valve hosing 250 and of which a plunger hydraulic line 225 is formed thereto, wherein the plunger hydraulic line 225 selectively communicates the fourth oil control hydraulic line 640 with the second oil control hydraulic line 620, or selectively communicates the second oil control hydraulic line 620 with the first oil control hydraulic line 610.

The first oil control valve 200 may further include a coil 210 selectively moving the plunger 220, and a plunger spring 230 or 240 supplying restoring force to the plunger 220.

The coil 210 receives electric power from a power supplier and selectively moves the plunger 220. In the drawing, two plunger springs 230 and 240 are disposed to both ends of the plunger 220 for supplying restoring force thereto. However, it is not limited thereto. On the contrary, one plunger spring may be disposed for supplying restoring force to the plunger 220 with variations.

Referring to FIG. 1 and FIG. 4, the accumulator 400 includes an accumulator housing 430 connected with the fourth oil control hydraulic line 640, an accumulator piston 410 which is slidably disposed within the accumulator housing 430 according to receiving oil supplied from the fourth oil control hydraulic line 640, and an accumulator spring 420 which is disposed within the accumulator housing 430 and supplies restoring force to the accumulator piston 410.

The accumulator 400 may release hydraulic pressure of the first EHV apparatus 100 or the second EHV apparatus 101 when the first oil control valve 200 or the second oil control valve 300 are operated.

An engine hydraulic pump 500 may be disposed on the fourth oil control hydraulic line 640.

The system further includes a check valve 510 which selectively blocks oil supplied from the engine hydraulic pump 500 to the fourth oil control hydraulic line 640, and a check valve spring 520 elastically supporting the check valve 510.

The engine hydraulic pump 500 supplies hydraulic pressure (oil) for operating the EHV system according to an exemplary embodiment of the present invention, and the check valve 510 and the check valve spring 520 maintains proper hydraulic pressure for the EHV system and prevents flowing backward of the hydraulic pressure to the engine hydraulic pump 500.

Referring to FIG. 1 and FIG. 2, the first and second EHV apparatus 100 and 101 includes respectively an EHV housing 40, a hydraulic piston 50 which is slidable within the EHV housing 40 according to forming hydraulic pressure within the main chamber 32 and includes a first body 52 having a first diameter, and a second body 56 connected to a valve 99 and having a second diameter larger than the first diameter, and a piston guide 60 which is disposed between the EHV housing 40 and the hydraulic piston 50 and guides the hydraulic piston 50.

The piston guide 60 is disposed between the first body 52 and the EHV housing 40, the first body 52 and the EHV housing 40 form the first assist chamber 70, and the second body 56, the EHV housing 40 and the piston guide 60 form the second assist chamber 72. And the first body 52 is provided with a first hydraulic piston hydraulic line 54 selectively connecting the first assist chamber 70 and the second assist chamber 72, and a second hydraulic piston hydraulic line 58 always connecting the first assist chamber 70 and the second assist chamber 72.

The first hydraulic piston hydraulic line 54 is closed by the piston guide 60 when the valve 99 is closed.

The second body 56 is provided with a hydraulic pressure valve lash adjuster 80 for adjusting clearance of the valve 99.

The hydraulic pressure valve lash adjuster 80 includes a first lash adjusting chamber 82 formed to the second body 56, a first lash adjusting hydraulic line 84 formed to the EHV housing 40, a second lash adjusting hydraulic line 86 formed to the second body 56 for connecting the first lash adjusting chamber 82 and the first lash adjusting hydraulic line 84, a lash adjusting housing 88 which forms a second lash adjusting chamber 98 with the second body 56 and is connected with the valve 99, a lash adjusting spring 90 disposed between the lash adjusting housing 88 and the second body 56 and elastically supporting the lash adjusting housing 88, a communicate hole 92 formed for communicating the first lash adjusting chamber 82 with the second lash adjusting chamber 98, a one-way valve 94 disposed within the lash adjusting housing 88 and selectively closing the communicate hole 92, and a one-way valve spring 96 elastically supporting the one-way valve 94.

Referring to FIG. 1 and FIG. 2, operations of the first and second EHV apparatus 100 and 101 applied to the EHV system according to an exemplary embodiment of the present invention will be described.

In high load operation, the hydraulic piston 50 reciprocates by the rotation of the drive cam 10 and the valve 99 is opened.

At the beginning of the valve 100 opening, the first hydraulic piston hydraulic line 54 is closed by the piston guide 60 and thus the oil in the first assist chamber 70 flows into the second assist chamber 72 only through the second hydraulic piston hydraulic line 58. And the oil in the first assist chamber 70 flows into the second assist chamber 72 through the second hydraulic piston hydraulic line 58 and the first hydraulic piston hydraulic line 54 when the first hydraulic piston hydraulic line 54 is opened.

And thus, when the first hydraulic piston hydraulic line 54 is closed, the valve 99 is opened smoothly as forming ramp and the oil in the first assist chamber 70 flows into the second assist chamber 72 through the second hydraulic piston hydraulic line 58 and the first hydraulic piston hydraulic line 54 forming normal valve profile.

When the valve 99 is closed, the oil in the second assist chamber 72 flows into the first assist chamber 70 through the first hydraulic piston hydraulic line 54 and the second hydraulic piston hydraulic line 58. However, the oil in the second assist chamber 72 flows into the first assist chamber 70 only through the second hydraulic piston hydraulic line 58 when the first hydraulic piston hydraulic line 54 is closed by the piston guide 60.

And thus, when the first hydraulic piston hydraulic line 54 is opened, normal valve profile is achieved. But when the first hydraulic piston hydraulic line 54 is closed, the oil in the second assist chamber 72 flows into the first assist chamber 70 only through the second hydraulic piston hydraulic line 58 as forming ramp and thus the valve 99 is closed smoothly.

In the high load operation, ramp profile may be obtained according to shape of a lobe of the drive cam 20 regardless of reciprocal motion of the hydraulic piston 50 and the first hydraulic piston hydraulic line 54.

A profile of the pump piston 20 is shown in right side of the drive cam 10 and each valve profile is shown in right side of the first EHV apparatus 100 and left side of the second EHV apparatus 101 in FIG. 1.

Figure 6:
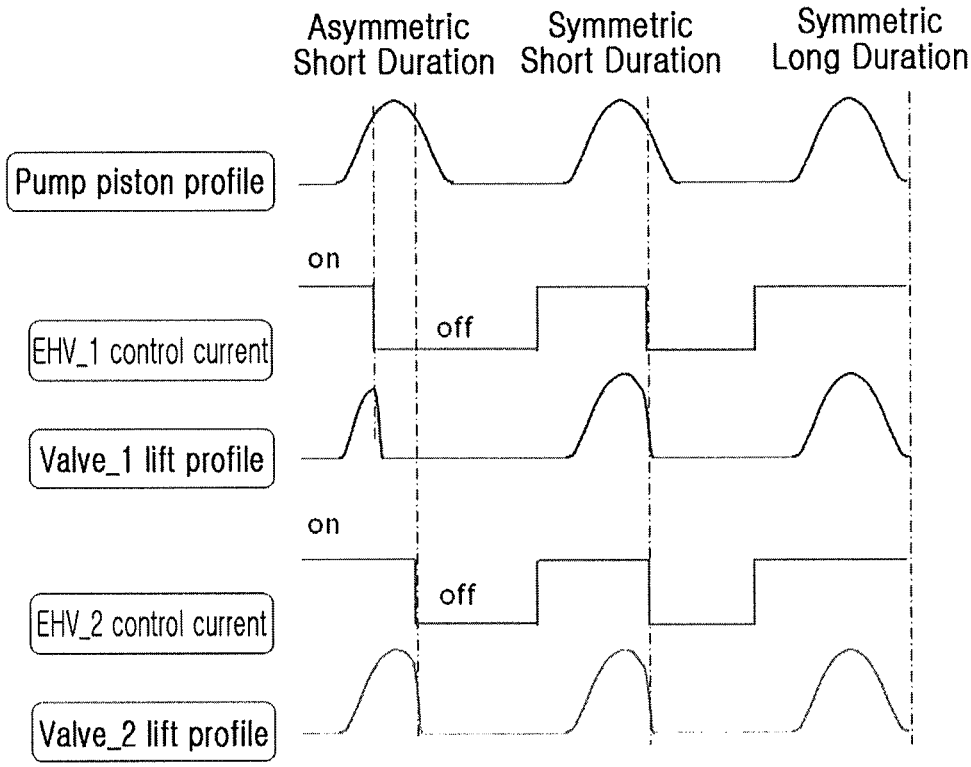
FIG. 6 is a graph showing operations of an EHV system according to an exemplary embodiment of the present invention.

Referring to FIG. 1, FIG. 4 and FIG. 6, in the middle load, after the pump piston 20 passes a peak point, the first oil control valve 200 communicates the second oil control hydraulic line 620 with the fourth oil control hydraulic line 640 and the second oil control valve 300 communicates the third oil control hydraulic line 630 with the fourth oil control hydraulic line 640 simultaneously.

As shown in FIG. 3, in the moment of the valve 99 opening, the plunger hydraulic line 225 communicates the first the first control hydraulic line 610 with the second control hydraulic line 620 and thus the oil in the main chamber 32 is supplied to the first EHV apparatus 100. And then, after the pump piston 20 passes the peak point, the plunger 220 is moved by the operation of the coil 210 as shown in FIG. 5. And then, the plunger hydraulic line 225 communicates the second oil control hydraulic line 620 with the fourth oil control hydraulic line 640. And thus, the oil in the first EHV apparatus 100 is released at the accumulator 400 through the second oil control hydraulic line 620 and the fourth oil control hydraulic line 640.

During the oil in the main chamber 32 is supplied to the second EHV apparatus 101, the third oil control hydraulic line 630 and the fourth oil control hydraulic line 640 are communicated with by the operation of the second oil control valve 300. And thus, the oil in the second EHV apparatus 101 is released at the accumulator 400 though the third oil control hydraulic line 630 and the fourth oil control hydraulic line 640.

When the first oil control valve 200 and the second oil control valve 300 are operated simultaneously, as shown "Symmetry Short Duration" in FIG. 6, the valve lift duration which is shorter than the profile of the pump piston 20 may be achieved.

The scheme or construction of the second oil control valve 300 is obvious to a person skilled in the art from the scheme of the first oil control valve 200 and a conventional art, and thus detailed description will be omitted.

In the low load operation, mixing of air and fuel inflowing a cylinder is required for forming swirl, and asymmetric valve profiles are preferable in a particularly GDI engine.

For forming asymmetric valve profile, the first oil control valve 200 is operated first and then the second oil control valve 300 is operated. (Referring to Asymmetric Short Duration in FIG. 6)

If the first oil control valve 200 is operated and then the second oil control valve 300 is operated, the first EHV apparatus 100 is closed first and then the second EHV apparatus 101 is closed.

In the high load operation, as shown "Symmetry Long Duration" in FIG. 6, the first oil control valve 200 and the second oil control valve 300 are not operated and thus the first EHV apparatus 100 and the second EHV apparatus 101 may have the same profile as the profile of the pump piston 20.

The oil control hydraulic line 600 is constituted as shown in FIG. 1 to FIG. 4, and thus operations of the first EHV apparatus 100 and the second EHV apparatus 101 do not influence each other. So flowing back of the oil and interference may be prevented and independent controls may be possible.

Also, according to an exemplary embodiment of the present invention, if the first oil control valve 200 and the second oil control valve 300 are operated constantly so that the first oil control hydraulic line 610 is communicated with the fourth oil control hydraulic line 640, and the third oil control hydraulic line 630 is communicated with the fourth oil control hydraulic line 640, the valve 99 is not opened or closed regardless the operation of the drive cam 10. That is CDA (cylinder deactivation) may be realized.

Hereinafter, referring to FIG. 1, operations of the hydraulic pressure valve lash adjuster 80 will be described.

At the moment of the valve 99 closing, hydraulic pressure is supplied to the first lash adjusting chamber 82 through the first lash adjusting hydraulic line 84 and the second lash adjusting hydraulic line 86.

If a gap is formed between the valve 99 and a valve seat, hydraulic pressure is supplied from the first lash adjusting chamber 82 to the second lash adjusting chamber 98 during reciprocal motion of the hydraulic piston 50 and thus the gap of the valve 99 is adjusted.

If the gap of the valve 99 is proper, the one-way valve 94 closes the communicate hole 92 by the operation of the one-way valve spring 96 and thus the valve 99 is opened and closed exactly.

As described above, the EHV system according to an exemplary embodiment of the present invention may operate each EHV apparatus simultaneously or sequentially and thus air flowing efficiency may be improved particularly in the low load operation.

In the low load, the valve profile may be asymmetric and thus performance in the low load may be improved particularly in the GDI engine.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An electro-hydro valve lift (EHV) system comprises:

a drive cam;

a pump piston housing of which a main chamber is formed therein;

a pump piston which is disposed within the pump piston housing and reciprocates according to operation of the drive cam;

a pump piston elastic member which is disposed within the pump piston housing and supplies restoring force to the pump piston;

a first and a second EHV apparatus disposed to each cylinder;

a first oil control valve;

a first oil control hydraulic line fluid-communicating the main chamber with the first oil control valve;

a second oil control hydraulic line fluid-communicating the first oil control valve with the first EHV apparatus;

a third oil control hydraulic line fluid-communicating the main chamber with the second EHV apparatus;

a fourth oil control hydraulic line of which an end is selectively fluid-communicated with the second oil control hydraulic line according to operation of the first oil control valve and of which the other end is fluid-communicated with the third oil control hydraulic line;

an accumulator fluid-communicated with the fourth oil control hydraulic line; and a second oil control valve which is disposed on the fourth oil control hydraulic line and selectively communicates the second EHV apparatus with the accumulator, wherein the fourth oil control hydraulic line is fluid-communicated with the third oil control hydraulic line according to operation of the second oil control valve.

2. The EHV system of claim 1, wherein:

the first oil control valve and the second oil control valve selectively fluid-communicates the second oil control hydraulic line and the third oil control hydraulic line with the fourth oil control hydraulic line simultaneously; or the first oil control valve and the second oil control valve selectively fluid-communicates the second oil control hydraulic line and the third oil control hydraulic line with the fourth oil control hydraulic line sequentially.

3. The EHV system of claim 1, wherein the first oil control valve comprises:

an oil control valve housing connected with the fourth oil control hydraulic line, the second oil control hydraulic line and the first oil control hydraulic line; and a plunger which is slidably disposed within the oil control valve hosing and of which a plunger hydraulic line is formed thereto, wherein the plunger hydraulic line fluid-communicates the fourth oil control hydraulic line with the second oil control hydraulic line, or fluid-communicates the second oil control hydraulic line with the first oil control hydraulic line, in accordance with operation of the plunger.

4. The EHV system of claim 3, wherein the first oil control valve further comprises:

a coil selectively moving the plunger; and a plunger spring mounted to an end portion of the plunger and supplying restoring force to the plunger.

5. The EHV system of claim 1, wherein the accumulator comprises:

an accumulator housing fluid-connected with the fourth oil control hydraulic line;

an accumulator piston which is disposed within the accumulator housing and slidable according to receiving oil supplied from the fourth oil control hydraulic line; and an accumulator spring which is disposed within the accumulator housing and supplies restoring force to the accumulator piston.

6. The EHV system of claim 1, wherein the system further comprises an engine hydraulic pump disposed on the fourth oil control hydraulic line.

7. The EHV system of claim 6, wherein the system further comprises:

a check valve disposed between the engine hydraulic pimp and the fourth oil control hydraulic line and selectively blocking oil supplied from the engine hydraulic pump to the fourth oil control hydraulic line according to an oil pressure applied thereto; and a check valve spring elastically supporting the check valve toward the engine hydraulic pump.

8. The EHV system of claim 1, wherein the first and second EHV apparatus comprises respectively:

an EHV housing;

a hydraulic piston which is slidable within the EHV housing according to a hydraulic pressure within the main chamber and comprises a first body having a first diameter, and a second body connected to the first body and a valve and having a second diameter larger than the first diameter; and a piston guide disposed between the EHV housing and the hydraulic piston and guiding the hydraulic piston.

9. The EHV system of claim 8, wherein:

the piston guide is disposed between the first body and the EHV housing;

the first body and the piston guide form a first assist chamber; and the second body, the EHV housing, and the piston guide form a second assist chamber, wherein the first body is provided with:

a first hydraulic piston hydraulic line selectively connecting the first assist chamber and the second assist chamber according to operation of the hydraulic piston; and a second hydraulic piston hydraulic line continuously connecting the first assist chamber and the second assist chamber.

10. The EHV system of claim 9, wherein the first hydraulic piston hydraulic line is closed by the piston guide when the valve is closed and the second body of the hydraulic piston contacts the piston guide.

11. The EHV system of claim 8, wherein the second body is provided with a hydraulic pressure valve lash adjuster for adjusting clearance of the valve.

12. The EHV system of claim 11, wherein the hydraulic pressure valve lash adjuster comprises:

a first lash adjusting chamber formed to the second body;

a first lash adjusting hydraulic line formed to the EHV housing;

a second lash adjusting hydraulic line formed to the second body for selectively connecting the first lash adjusting chamber and the first lash adjusting hydraulic line;

a lash adjusting housing slidably receiving the second body to form a second lash adjusting chamber with the second body and connected with the valve;

a lash adjusting spring disposed between the lash adjusting housing and the second body in the second lash adjusting chamber and elastically supporting the lash adjusting housing and the second body;

a communication hole formed in the second body and fluid-communicating the first lash adjusting chamber with the second lash adjusting chamber;

a one-way valve disposed within the lash adjusting housing and selectively closing the fluid-communicate hole; and a one-way valve spring elastically supporting the one-way valve.

* * * * *